US006896190B2

(12) United States Patent
Kobayashi et al.

(10) Patent No.: US 6,896,190 B2
(45) Date of Patent: May 24, 2005

(54) EXPANSION VALVE

(75) Inventors: Kazuto Kobayashi, Tokyo (JP); Kazuhiko Watanabe, Tokyo (JP); Masamichi Yano, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 10/689,052

(22) Filed: Oct. 21, 2003

(65) Prior Publication Data

US 2004/0079810 A1 Apr. 29, 2004

(30) Foreign Application Priority Data

Oct. 29, 2002 (JP) ..... 2002-314086

(51) Int. Cl.[7] ..... F25B 41/04

(52) U.S. Cl. ..... 236/92 B; 62/222; 137/613; 137/614

(58) Field of Search ..... 236/92 B; 62/222, 62/528; 137/613, 614

(56) References Cited

U.S. PATENT DOCUMENTS 6,092,733 A * 7/2000 Watanabe et al. ..... 236/92 B
6,533,245 B2 * 3/2003 Takemoto et al. ..... 251/368

FOREIGN PATENT DOCUMENTS

| | | | |
|---|---|---|---|
| EP | 0691517 | A1 | 1/1996 |
| EP | 0781970 | A1 | 7/1997 |
| EP | 0959310 | A2 | 11/1999 |
| EP | 1275916 | A2 | 1/2003 |
| JP | 2000-304381 | A1 | 11/2000 |

OTHER PUBLICATIONS

European Search Report dated Nov. 24, 2003.

* cited by examiner

*Primary Examiner*—Marc Norman
(74) *Attorney, Agent, or Firm*—Rader, Fishman & Grauer PLLC

(57) ABSTRACT

An expansion valve 1 includes a square rod-shaped valve body 10. A first path 20 into which refrigerant is introduced, a valve chamber 22 formed near the bottom of the path, a second path 24 for refrigerant heading toward an evaporator and a third path 26 for refrigerant returning from the evaporator are provided to the valve body 10. A valve member 30 provided inside the valve chamber is operated by a power element 70 via an actuating rod 60. In order to assemble the expansion valve, an assembled orifice member 40 and an assembled guide member 100 are press-fitted into an opening provided to the valve body 10.

6 Claims, 3 Drawing Sheets

EXPANSION VALVE

FIELD OF THE INVENTION

The present invention relates to an expansion valve for controlling the flow of refrigerant supplied to an evaporator according to the temperature of the refrigerant that is equipped to an air conditioning device for automobiles and the like.

DESCRIPTION OF THE RELATED ART

An example of a conventional expansion valve is disclosed in Japanese Patent Laid-Open Publication No. 2000-304381.

The conventional expansion valve requires a large number of components such as a valve receiving member, spring, adjusting screw and the like, thereby making it difficult to reduce the size and the weight of the expansion valve.

Also, there was a possibility that disadvantage such as leaking of refrigerant from a valve chamber through the control screw area may arise.

SUMMARY OF THE INVENTION

In response to the request for reducing size and weight of the air conditioners in automobiles, the present invention aims to provide an expansion valve with simplified structure and reduced assembly process.

In order to overcome the problems mentioned above, the expansion valve of the present invention is basically equipped with a valve body; a first path formed inside the valve body through which high-pressure refrigerant flows; a valve chamber with a bottom formed inside the first path; a second path formed inside the valve body parallel to the first path, through which refrigerant flowing toward an evaporator flows; an orifice member including a throttle passage that communicates the valve chamber with the second path, the orifice member being press-fitted into the valve body; a valve member disposed facing the orifice member; a third path through which refrigerant exiting the evaporator flows; an actuating rod for operating the valve member; an actuating device for driving the actuating rod; an opening formed to the valve body that communicates the third path with the actuating device; and a guide member for slidably guiding the actuating rod, the guide member being press-fitted into an opening communicating the second path with the third path of the valve body.

Also, the inner diameter size of the opening formed to the valve body and communicating the third path with the actuating device is larger than the inner diameter size of the opening into which the guide member is press-fitted, and the inner diameter size of the opening into which the guide member is press-fitted is larger than the inner diameter size of the opening into which the orifice member is press-fitted.

Moreover, the valve member is fixed to a valve supporting member, and is further equipped with a spring provided between the valve supporting member and the bottom of the valve chamber.

DETAILED DESCRIPTION OF THE PREFERRED EMBODIMENTS

Figure 1:
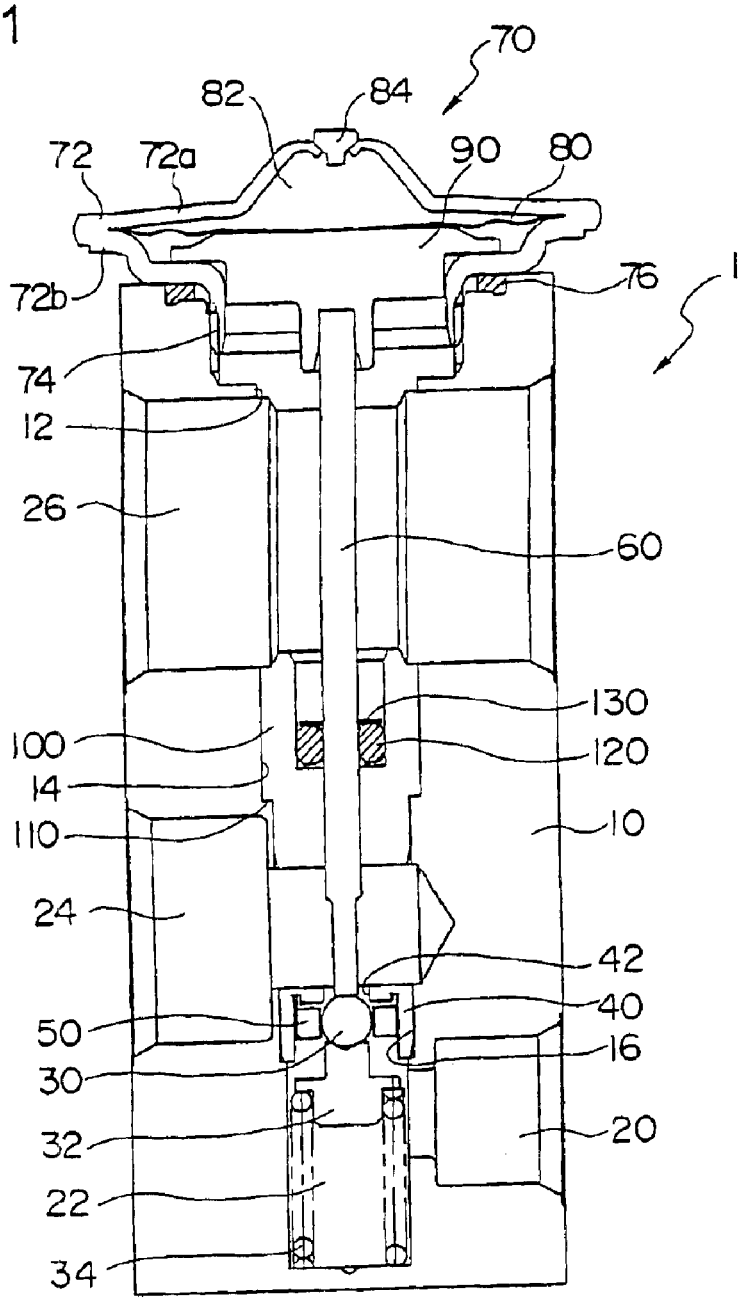
FIG. 1 is a cross-sectional view of the expansion valve of the present invention.
Figure 2:
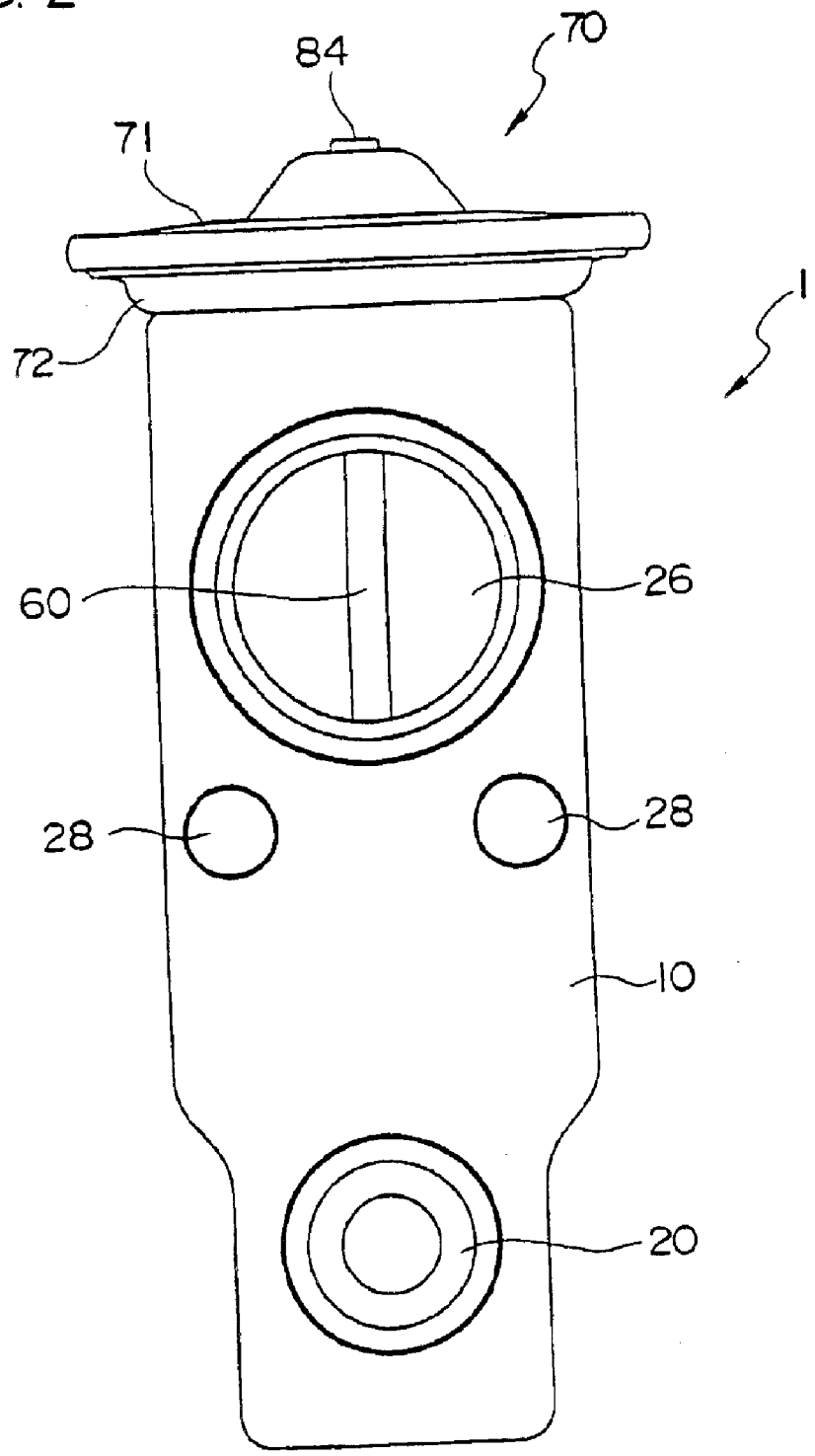
FIG. 2 is a right side view of FIG. 1.

FIG. 1 is a cross-sectional view of the expansion valve of the present invention, and FIG. 2 is a right side view of the same.

The expansion valve denoted as a whole by reference 1 includes a square rod-shaped valve body 10 made of aluminum alloy and the like, and a first path 20 for guiding the high-pressure refrigerant provided to the valve body 10. The first path 20 is connected to a valve chamber 22 having a bottom wall, and an orifice member 40 is press-fitted and fixed to the opening of the valve chamber 22.

A spherical valve member 30 is fixed to the supporting member 32 by welding, and is disposed inside the valve chamber 22. The supporting member 32 forces the valve member 30 toward the orifice member 40 at all times with a spring 34.

The orifice member 40 includes an opening 42 at the central portion thereof, and forms a flow path of the refrigerant between the valve member 30. A vibration insulating member 50 is fitted to the inner diameter portion of the orifice member 40 so as to prevent vibration of the valve member.

The refrigerant passing through the orifice member 40 is sent toward the evaporator through a second path 24. The refrigerant returning from the evaporator is sent towards the compressor side through a third path 26.

The end portion of the valve body 10 opposite to the valve chamber 22 is equipped with a valve member driving device (hereinafter referred to as power element) 70. The power element 70 includes a can member 72 formed by welding an upper lid 72*a* and a lower lid 72*b* together. A diaphragm 80 is interposed between the upper lid 72*a* and the lower lid 72*b*. The can body 72 is fixed to the valve body 10 via a screw portion 74, and is sealed by a sealing member 76. A pressure chamber 82 is formed between the diaphragm 80 and the upper lid 72*a*. The pressure chamber 82 is filled with actuating fluid, and is sealed by a plug member 84.

A stopper member 90 is provided to the other side of the diaphragm from the pressure chamber 82. The refrigerant in the third path is lead to the rear surface of the stopper member via an opening 12. The stopper member 90 slides to follow the displacement of the diaphragm 80. The stopper member 90 grips an actuating rod 60. The other end of the actuating rod is in contact with the valve member 30. The displacement of the diaphragm 80 drives the valve member 30 through the actuating rod 60, and controls the cross-sectional area of the flow path between the valve member and the orifice member 40.

A guide member 100 press-fitted to the valve body 10 includes a step portion 110, and is fixed to the valve body 10 with its position strictly determined. A ring-shaped sealing member 120 is inserted to the inner diameter portion of the guide member 100, and is fixed by a stopper 130 such as a push nut and the like. The sealing member 120 blocks the flow of refrigerant between the second path 24 and the third path 26.

Figure 3:
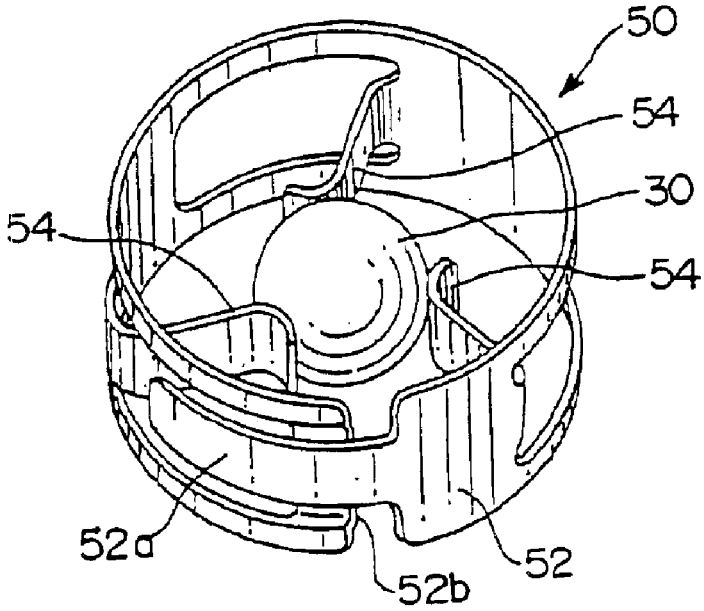
FIG. 3 is a perspective view of the vibration insulating member.

FIG. 3 is a perspective view indicating the structure of the vibration insulating member 50.

The vibration insulating member 50 includes a ring portion 52 formed by bending a metal plate having high elasticity into a circular shape, and a retaining portion 54 formed by providing a slit to the ring portion and bending the metal to the inner direction of the ring portion.

Both end portions 52*a* and 52*b* of the ring portion 52 are formed so as to overlap one another. The ring portion 52 is inserted to the inner diameter portion of the orifice member 40 in the state in which the diameter of the ring portion 52 is reduced. By utilizing the elastic force of the ring portion restoring its original diameter, the vibration insulating member 50 is positioned inside the orifice member 40.

The retaining portion 54 contacts the outer periphery of the spherical valve member 30, and restrains the vibration of the valve member 30.

In the present embodiment, three retaining portions 54 are provided. However, it is also possible to provide four retaining portions 54.

Next, the assembly procedure of the present expansion valve will be explained.

First, the supporting member 32 with the spring 34 and the valve member 30 welded thereto is inserted inside the valve chamber 22 with a bottom via the opening 12 on the side of the valve body 10 for fitting the power element 70.

Next, the assembled orifice member 40 fitted with the vibration insulating member 50 is inserted via the opening 12, and is press-fitted into the opening 16 of the valve chamber 22.

The orifice member 40 is press-fitted by using a proper press-fitting tool, and is further fixed by caulking when necessary.

Then, the guide member 100 having the actuating rod 60 inserted thereto is inserted from the opening 12, and is press-fitted to the stepped hole 14 of the valve body 10. The axial position of the guide member 100 is determined by the stepped portion 110. The guide member is further fixed by caulking, if necessary.

Finally, the assembled power element 70 is screwed onto the valve body 10 at the screw portion 74, thereby completing assembly of the expansion valve.

The expansion valve of the present invention is formed so as to have openings where the inner diameter of the opening is decreased sequentially from the opening side to which the power element is attached, and to have the hole with a bottom at the far end thereof. The present invention forms the valve chamber by mounting the valve member and the assembled orifice member to this opening, and press-fitting the assembled guide member that guides the actuating rod, so as to form the paths for the high-pressure-side refrigerant and the low-pressure-side refrigerant.

With the structure mentioned above, the number of overall components of the expansion valve can be reduced, and the required assembling time can also be reduced.

What is claimed is:

1. An expansion valve comprising:

a valve body;

a first path formed inside said valve body through which high-pressure refrigerant flows;

a valve chamber with a bottom formed inside said first path;

a second path formed inside said valve body parallel to said first path, through which refrigerant flowing toward an evaporator flows;

an orifice member including a throttle passage that communicates said valve chamber with said second path, said orifice member being press-fitted into said valve body;

a valve member disposed facing said orifice member;

a third path through which refrigerant exiting said evaporator flows;

an actuating rod for operating said valve member;

an actuating device for driving said actuating rod;

an opening formed to said valve body that communicates said third path with said actuating device;

a guide member for slidably guiding said actuating rod, said guide member being press-fitted into an opening communicating said second path with said third path of said valve body; and a vibration insulating member disposed in the valve chamber and connected to the orifice member with the valve member in slidable contact with the vibration insulating member.

2. The expansion valve according to claim 1, wherein the inner diameter size of said opening formed to said valve body and communicating said third path with said actuating device is larger than the inner diameter size of said opening into which said guide member is press-fitted, and the inner diameter size of said opening into which said guide member is press-fitted is larger than the inner diameter size of said opening into which said orifice member is press-fitted.

3. The expansion valve according to claim 1, wherein said valve member is fixed to a valve supporting member, and is further equipped with a spring provided between said valve supporting member and the bottom of said valve chamber.

4. The expansion valve according to claim 1, wherein the vibration insulating member includes a ring portion and a plurality of retaining portions connected to and extending inwardly relative to the ring portion.

5. The expansion valve according to claim 4, wherein the valve member is in slidable contact with the plurality of retaining portions.

6. The expansion valve according to claim 4, wherein the ring portion contacts the orifice member.

* * * * *